United States Patent [19]

Matsumoto et al.

[11] Patent Number: 4,641,980

[45] Date of Patent: Feb. 10, 1987

[54] PRINTER WITH PIVOTABLE PRINT HEAD ATTACHED TO MEDIUM CARRIER MOVEABLE THROUGH A CASING OPENING

[75] Inventors: Norio Matsumoto; Shinya Okuda; Osamu Ohkuma, all of Kawasaki; Mituyoshi Seino, Yokohama, all of Japan

[73] Assignee: Fujitsu Limited, Kawasaki, Japan

[21] Appl. No.: 782,922

[22] Filed: Oct. 2, 1985

[30] Foreign Application Priority Data

| | | | |
|---|---|---|---|
| Oct. 2, 1984 | [JP] | Japan | 59-206734 |
| Oct. 2, 1984 | [JP] | Japan | 59-206735 |
| Oct. 2, 1984 | [JP] | Japan | 59-206736 |
| Nov. 30, 1984 | [JP] | Japan | 59-253754 |
| Nov. 30, 1984 | [JP] | Japan | 59-253755 |

[51] Int. Cl.[4] ..... B41J 3/02

[52] U.S. Cl. ..... 400/120; 346/76 PH; 346/136

[58] Field of Search ..... 400/120, 88, 83, 84, 400/611, 613, 613.1, 621; 346/76 PH, 145, 136

[56] References Cited

U.S. PATENT DOCUMENTS

| | | | |
|---|---|---|---|
| 3,216,021 | 11/1965 | Stefansson | 346/136 |
| 3,787,886 | 1/1974 | McCrady | 346/136 X |
| 4,329,693 | 5/1982 | Goldschmidt et al. | 400/83 |
| 4,396,926 | 8/1983 | Manning et al. | 346/136 |
| 4,544,287 | 10/1985 | Teroaka | 400/120 |
| 4,568,950 | 2/1986 | Ross et al. | 400/120 |

FOREIGN PATENT DOCUMENTS

| | | | |
|---|---|---|---|
| 34465 | 4/1981 | Japan | 400/120 |

OTHER PUBLICATIONS

"Video Terminal Controller", IBM Tech. Discl. Bulletin, vol. 27, No. 5, 10/84, pp. 2765–2766.

"Facsimile Terminal", IBM Tech. Discl. Bulletin, vol. 22, No. 4, Sep. 79, pp. 1529–1530.

"Hidden Display Panel", IBM Tech. Discl. Bulletin, vol. 26, No. 12, May 1984, pp. 6259–6260.

"Paper Supply Apparatus", IBM Tech. Discl. Bulletin, vol. 12, No. 2, 7/69, p. 233.

*Primary Examiner*—E. H. Eickholt

*Attorney, Agent, or Firm*—Staas & Halsey

[57] ABSTRACT

A printer including a casing having a front face, a printing unit, and a control circuit. The printing unit includes a printing medium attaching portion and a printing head portion pivotably attached to the printing medium attaching portion. The printing unit is supported in the casing by a moving mechanism so that the printing unit can be freely drawn out forward from the front face of the casing. The moving mechanism also automatically positions the printing head in an open position with respect to the printing medium attaching portion when the printing unit is drawn out from the casing.

9 Claims, 13 Drawing Figures

PRINTER WITH PIVOTABLE PRINT HEAD ATTACHED TO MEDIUM CARRIER MOVEABLE THROUGH A CASING OPENING

BACKGROUND OF THE INVENTION

1. Field of the Invention

The present invention relates to a printer, such as a thermal printer or electrosensitive printer, for hard-copying an image output from a television set or video tape recorder, or an image output from a personal computer.

2. Description of the Related Art

In conventional thermal printers, a top lid of a casing is arranged so that it can be opened for setting or checking the quantity of a roll of heat-sensitive recording paper used as the printing medium. When the quantity of heat-sensitive recording paper remaining on the roll becomes small, the top lid is opened, the roll of heat-sensitive recording paper is taken out, and a new roll of heat-sensitive recording paper is set therein. Checking or maintenance of the printing zone or the like is also performed with the top lid open.

In a printer having a structure in which a top lid is opened and closed in the above-mentioned manner, articles must not be placed on the printer and the space on and immediately above the printer should be always empty and vacant. Thus, this type of printer is not preferable from the viewpoint of the effective utilization of space. Furthermore, the printer cannot be inserted into a unit such as a rack having a narrow horizontal space. When a structure is adopted in which the heat-sensitive recording paper is set in the printer from above, an operation panel or the like is usually arranged on the upper side of a casing, and in this case, the printer must be placed at a low position, for example, on a desk, so that the operation panel can be easily seen. Namely, the location of the printer is limited.

Also, in a conventional printer, the printing paper approaches the platen from the lower rear portion and is in sliding contact with the front face of the platen where printing is effected. Then, the printing paper is delivered upward and taken out from the upper portion of the printer. Because of this structure, other devices cannot be positioned at the upper portion or placed on top of the printer, and there again arises the problem of the proper utilization of space.

In another conventional technique, a printer is provided with a door arranged on the front face of the printer, through which the printing paper is set. In this printer having a front facing door, to facilitate the operation of setting the printing paper, the printing paper is arranged on the front side and the platen is arranged vertically to the printing paper. Accordingly, the thickness of the printer is increased and a large usage space is required in the vertical direction.

Moreover, in the conventional printer, when a roll of continuous printing paper is attached, since the space between the platen and the printing head is narrow, the operation of setting the roll of continuous printing paper at a predetermined position while passing it between the platen and the printing head is very difficult.

SUMMARY OF THE INVENTION

The present invention has been completed as the result of research made with a view to overcoming the foregoing defects of the conventional techniques. It is therefore a primary object of the present invention to provide a printer having a thin and compact structure and a good operation property, in which the space above the top face is completely open, and thus another device can be optionally set thereon, an attachment portion for recording medium such as a heat-sensitive recording paper roll is freely detachable from the front face so that the recording medium can be freely set and dismounted, and this operation of setting and dismounting the recording medium can be performed very easily.

In accordance with the present invention, there is provided a printer comprising a casing having a substantially cuboidal shape with an operation panel portion formed on the front face thereof, in which at least a printing head portion, a printing medium-attaching portion, and a control circuit for controlling the printing operation of the printing head portion are stored; at least the printing medium-attaching portion being supported in the casing by a movable mechanism in such a manner that the printing medium-attaching portion can be freely drawn out forward from the front face of the casing.

DESCRIPTION OF THE PREFERRED EMBODIMENTS

The embodiments of the present invention will now be described with reference to the accompanying drawings.

Figure 1:
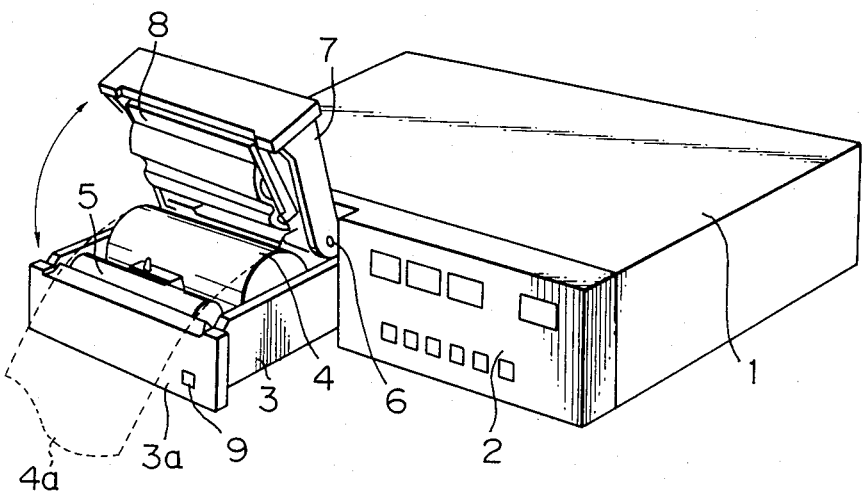
FIG. 1 is a perspective view of an image printer of the present invention with the printing mediumattaching portion drawn out.
Figure 2:
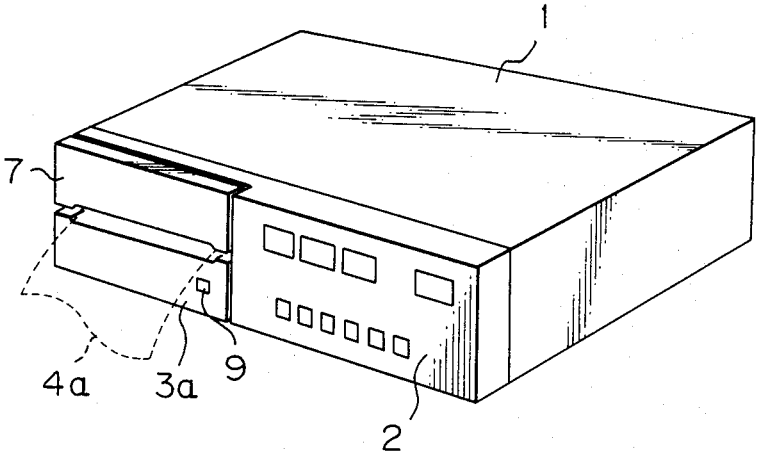
FIG. 2 is a perspective view of the image printer of FIG. 1 in the closed state.

FIGS. 1 and 2 are perspective views of the printer of the present invention, in which FIG. 1 illustrates the state where the printer portion is drawn out and FIG. 2 illustrates the closed state where the printing portion is contained in a casing. Reference numeral 1 represents a casing of the printer in which a control circuit for controlling the printing portion, a paper feed mechanism and the like, and a power source portion are contained. An operation panel 2 is arranged on the front face of the casing 1, and operation switches and display means are arranged on the operation panel 2. The casing 1 has a substantially cuboidal shape. It is noted that concaveconvex, inclined and curved parts may be formed on the side and front face of the casing for decorative or functional purposes.

A printing portion and a printing medium-attaching portion are also contained in the casing 1. Ordinarily, the printing portion and printing medium-attaching portion are contained in the casing 1 at the side of the operation panel 2 as illustrated in FIG. 2. However, when the printing medium is being loaded or unloaded, as shown in FIG. 1, the printing portion and printing medium-attaching portion are drawn out in a forward direction.

Referring to FIG. 1, a draw-out frame 3, having a shape similar to that of a drawer of a desk or the like, is attached to guide rail (not shown) formed on the casing 1 so that the frame 3 can be moved forward and backward. A heat-sensitive recording paper roll 4, acting as the printing medium, is contained in the printing medium-attaching portion in the draw-out frame 3. A platen 5 is arranged between the roll 4 and a front plate 3*a* of the draw-out frame 3. At the inner part of the draw-out frame 3, a cover-like arm 7 is rotatably attached by a supporting shaft 6. A thermal head 8 is arranged at a position confronting the platen 5 on the lower side of arm 7. In the state shown in FIG. 1, arm 7 is in the open position. When the arm 7 is pushed down into the closed position, a heat-generating element portion (not shown) of the thermal head 8 is pressed against the platen 5 by spring means (not shown). A heat-sensitive recording paper 4*a* delivered from the heat-sensitive recording paper roll 4 is guided forward of the casing 1 through and between the platen 5 and the thermal head 8. Accordingly, the heat-generating element of the thermal head 8 is brought into pressure contact with the heat-sensitive recording paper 4*a* on the platen 5. Where the draw-out frame 3 is pushed into the casing 1 when arm 7 is in the closed position above the heat-sensitive recording paper 4*a*, the state shown in FIG. 2 is brought about, and the printing portion and printing medium-attaching portion are contained in the casing 1. When the heat-generating element is actuated according to the information to be printed, heat is selectively generated in the heat-generating element to heat the heat-sensitive recording paper 4*a*, whereby printing is performed. The heat-generating element of the thermal head 8 and the feed mechanism for the heat-sensitive recording paper are electrically connected to the control circuit and power source portion in the casing 1 through cables (not shown).

The heat-generating element of the thermal head 8 consists of 100 to 200 resistors arranged in a line. In the control circuit, for example, an image signal is divided into 16 or 32 stages according to the densities of respective parts of the image, and the application of an electric current to the respective resistors is controlled according to the density levels, whereby an image consisting of parts differing in density is formed. A structure may be adopted in which a color print is formed by a color image signal. A printing signal as described above is formed, for example, from an image signal output by a television set, and if the printer is connected to the television set, a picture received and shown by the television set can be printed by the printer. Furthermore, when the printer is connected to a video tape system or video disc system, information stored in the video tape or on the video disc can be printed by the printer. Moreover, when the printer is connected to a microcomputer, information stored therein can be printed, and information input through various information exchange systems using telephone lines also can be printed by the printer.

In this printer, the setting of the printing medium is performed in the following manner. The draw-out frame 3 is drawn out and the arm 7 is turned upward to the open position, the heat-sensitive recording paper roll 4 is set in the printing medium-attaching portion between the arm 7 and the bottom portion of the draw-out frame 3, and the heat-sensitive recording paper 4a is then taken out from above the platen 5. The arm 7 is then turned downward to the closed position, and in this closed state, the draw-out frame 3 is pushed into the casing 1, this completing the setting of the printing medium.

The operation of drawing out the draw-out frame 3 from the casing 1 or pushing it into the casing 1 may be manually performed, or may be carried out by a motor. In the latter case, the motor is operated by a changeover switch 9 arranged on the front plate 3*a* of the draw-out frame 3. The raising and lowering of the arm 7 may be linked with the backward-forward movement of the draw-out frame 3, and a locking mechanism may be specially provided for the manual operation of raising and lowering the arm 7.

Figure 3:
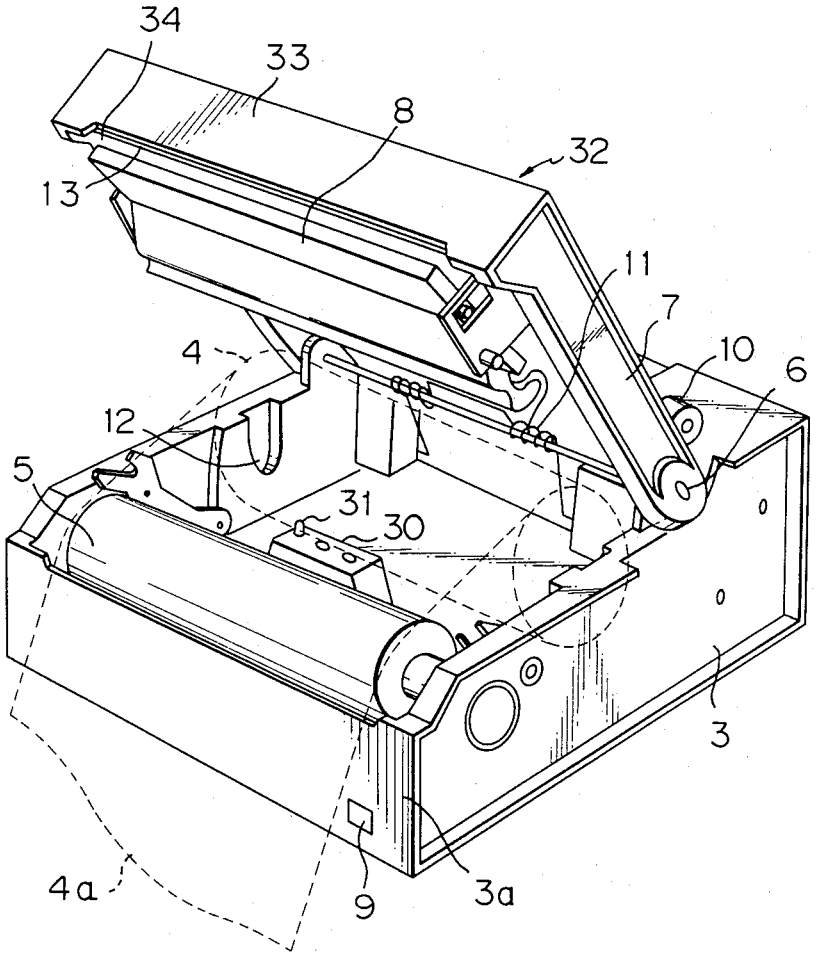
FIG. 3 is a perspective view illustrating in detail the printing medium-attaching portion of the image printer of FIG. 1.
Figure 4:
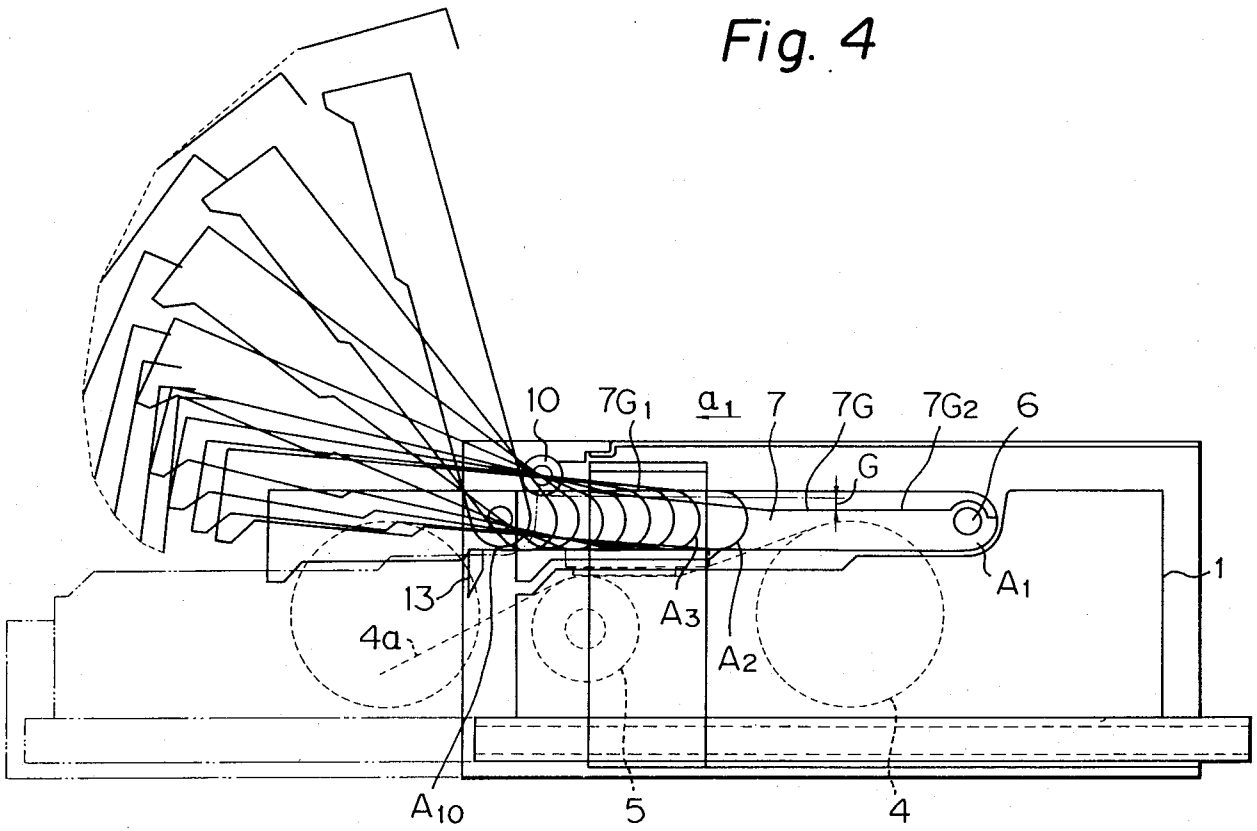
FIG. 4 is a diagram illustrating the operation of the printing medium-attaching portion shown in FIG. 3.

The linkage mechanism for the arm 7 and the draw-out frame 3 will now be described with reference to FIGS. 3 and 4. FIG. 3 is a perspective view of the printing portion and the printing medium-attaching portion in the open position, and FIG. 4 is a side view illustrating the opening and closing operations of the arm 7. In the draw-out frame-containing portion of the casing 1, guide rollers 10 are arranged in the inner-top portion of the front face of the casing 1. These guide rollers 10 are positioned on both the left and right sides above the draw-out frame 3, and left and right guide faces 7G (FIG. 4) of the arm 7 are located below these left and right guide rollers 10. The arm 7 is moved forward and backward together with the draw-out frame 3, and this forward-backward movement is preferably performed by the driving action of a motor. For example, if the casing 1 is connected to the draw-out frame 3 by a known feed mechanism comprising a rack and pinion, or they are connected by screws, the draw-out frame 3 may be moved forward and backward simply by operating switch 9.

The front part 7G1 of the guide face 7G of the arm 7 is inclined, with the guide roller 10 abutting against the top end of the inclined portion 7G1. The rear part 7G2 of the guide face 7G close to the supporting shaft 6 is flat and is separated by a gap G from the lower face of the guide roller 10.

A torsion coil spring 11 is wound on the supporting shaft 6 symmetrically on the left and right sides thereof, with one end of the coil spring 11 supported on the draw-out frame and the other end supported on the arm 7, whereby the arm 7 is urged in the opening direction (upward).

Referring to FIG. 4, the state where the draw-out frame 3 is contained in the casing is designated as A1, whereas A2 to A10 represent various stages of draw-out. When the draw-out frame 3 is moved outward from the interior of the casing 1 by the driving mechanism, and while the supporting shaft 6 is remote from the guide roller 10, that is, during the period between A1 and A2, even if the draw-out frame 3 and the arm 7 are moved in the forward direction indicated by an arrow a1, the arm 7 cannot be moved upward since the upper part of the inclined portion 7G1 of the arm 7 is under pressure from the guide roller 10. However, as the arm 7 moves to the position A3 so that the supportin shaft 6 approaches the guide roller 10, the lower part of the inclined portion 7G1 is advanced to the position of the guide roller 10. Thus, the arm 7 is moved slightly upward by the torsion spring 11 with the supporting shaft 6 as the center of rotation. As the supporting shaft 6 s further advanced to A3, A4, . . . , the arm 7 is made to move further upward. When the supporting shaft 6 is advanced to the position A10 where the advance stroke terminates, the arm 7 is substantially released from the control of the guide roller 10 and is in a substantially vertical position as shown in FIG. 4.

When the arm 7 is in the open position, the heat-sensitive recording paper roll 4 is set at the position indicated by the broken line in FIG. 3, and the heat-sensitive recording paper 4*a* is guided outward over the platen 5. Note, reference numeral 12 represents a shaft receiver for the recording paper roll 4. When the setting of the recording paper roll 4 is completed, the draw-out frame 3 is pushed back into the casing 1. Namely, as the arm 7 is moved backward in the direction opposite to the direction of the arrow a1, the arm 7 is pushed down by the guide roller 10 and brought to the closed position through positions A10, A9, . . . A3. At the position A2, the arm 7 is substantially in the fully closed position, and at the position A1 where the backward stroke terminates, the arm 7 is completely in the fully closed position. When the heat-generating element of the thermal head 8 is actuated according to the information to be printed, heat is selectively generated in the heat-generating element to heat the heat-sensitive recording paper 4*a*, whereby printing is performed, and simultaneously, the heat-sensitive recording paper 4*a* is fed upwards. When the printing of one page is completed, the printed paper is cut from the roll 4 by a cutter 13.

In the embodiment illustrated on the drawings, the printing head, that is, the thermal head 8, is attached to the arm 7, but a structure may be adopted in which the platen 5 is attached to the arm 7 and the thermal head 8 is attached to the draw-out frame 3. Furthermore, the spring force for moving the arm 7 upward may be provided by means other than the torsion coil spring 11.

A printing paper detector is arranged on the back face of the platen 5. When the printing paper is charged, i.e., when recording paper 4*a* is present between teh platen 5 and the thermal head 8, a detection piece 31 projected upward by a spring (not shown) is pushed downward by the printing paper to detect charging of the printing paper. When the printing paper is not charged or is completely consumed, the detecting piece 31 is projected upward to detect the absence of the printing paper.

. The cutter 13 is arranged on the inner face of a paper exit 34 of a front face plate 33 of an openable lid 32 constructed by the arm 7. The cutter 13 may be formed integrally with the front face plate 33 or may be attached as an individual member to the front face plate 33 by appropriate means.

When the draw-out frame 3 is drawn out, the lid 32 is opened wide and the top face of the draw-out frame 3 is substantially in the open position. The heat-sensitive recording paper roll 4 can be inserted into the draw-out frame 3 through the thus-open top face from above, which enhances the convenience of the charging operation of the roll 4.

Instead of the above-mentioned structure where the lid 32 comprising the arm 7 of the draw-out frame 3 is automatically moved to the open position when the draw-out frame 3 is drawn out, a structure may be adopted in which a locking mechanism is attached to the lid 32, so that the lid 32 is opened by releasing the locking mechanism after the draw-out frame 3 is drawn out. An embodiment using such a locking mechanism will now be described with reference to FIGS. 5 through 8.

The arm 7 including the printing head 8 is considered a moving member, and the draw-out frame 3 holding the arm 7 by the supporting shaft 6 is considered a stationary member. A pin 41 is secured to the arm 7, and a pin 20 as an unlocking member is secured to the back portion (opposite to a claw 40) of a locking arm 19 at a position close to a supporting shaft 23.

The locking arm 19 is pivoted on the draw-out frame 3 through the supporting shaft 23. This locking arm 19 has on the top end thereof a claw 40 for locking a pin 41. In the present embodiment, a projection 21 to be depressed by a downward movement of the pin 20 is arranged on the back portion of the locking arm 19 at a position close to the supporting shaft 23.

A tension coil spring 22 is used at the spring for urging locking arm 19. One end of this tension coil spring 22 is attached to a hook 38 of the draw-out frame 3, and the other end of the tension coil spring 22 is attached to a pin 24 arranged in the vicinity of the projection 21 of the locking arm 19. The locking arm 19 is moved between the position indicated by the solid line and the position indicated by the chain line, and the pin 24 is arranged so that when the locking arm 19 is at the intermediate position (indicated by the dash line) the tension coil spring 22 is located just at the center of the supporting shaft 23 and this point becomes a dead point at which the locking arm 19 is not urged in any direction. Accordingly, when the tension coil pin 22 is located at a position closer to the pin 41 apart from the center of the supporting shaft 23, as indicated by the solid line, the locking arm 19 is urged toward the pin 41 to engage and lock with the pin 41. In contrast, when the tension coil spring 22 is located below the center of the supporting shaft 23, as indicated by the chain line, locking arm 19 is urged in the unlocking direction and separated from the pin 41.

An inclined portion 25 is formed on the back of the locking arm 19 at a position close to the claw 40. This inclined portion 25 is formed to return the locking arm 19 to the position indicated by the solid line from the position indicated by the chain line. Namely, when the pin 20 is elevated, the inclined portion at the position indicated by the chain line is pushed toward the pin 41 at the locking arm 19 is returned to the position indicated by the solid line.

The operation of this locking mechanism will now be described. Ordinarily, the tension coil spring 22 is located above the center of the supporting shaft 23 at a position capable of locking the pin 41. Accordingly, when the arm 7 is pushed down, the pin 41 of the arm 7 passes over the claw 40, so that the locking arm 19 is once moved backward to the position indicated by the dash line. After the pin 41 has passed over the top end of the claw 40, the locking arm 19 is returned to the position indicated by the solid line to lock the pin 41, whereby the arm 7 is held in the closed position.

Figure 5:
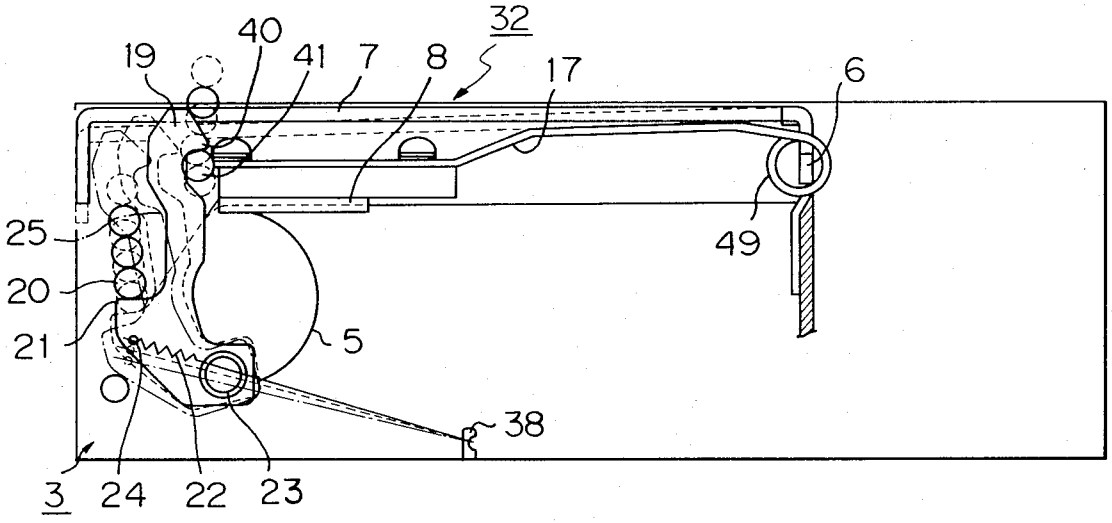
FIGS. 5 through 8 are diagrams illustrating, in sequence, the operations of a lock mechanism of the printing medium-attaching portion of the printer of the present invention.
Figure 8:
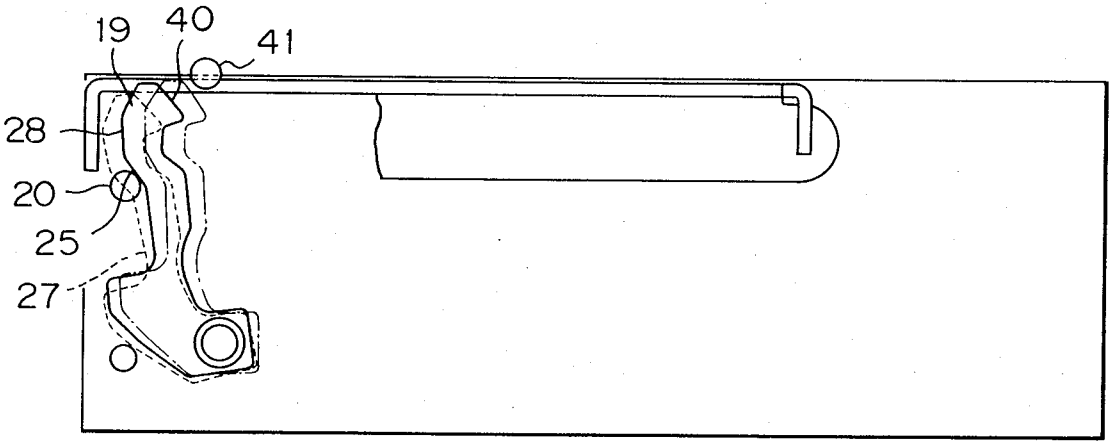

When in the closed position, locking is released (unlocking is effected) by pushing down on the arm 7, as described below. Namely, when the arm 7 is pushed down, the pin 41 is separated from the engaging face 18 (FIG. 6) of the claw 40, as indicated by the solid line in FIG. 6, and the projection 21 on the back of the locking arm 19 is pushed down by the pin 20 disposed on the back of the locking arm 19. The projection 21 is thus pushed down so that the tension coil spring 22 (FIG. 5) passes over the supporting shaft 23 and is moved below the center of the supporting shaft 23. When the tension coil spring 22 is moved below the center of the supporting shaft 23, the tension coil spring 22 urges the locking arm 19 in the unlocking direction as mentioned before. Accordingly, the locking arm 19 is pulled to the position indicated by the solid line in FIG. 7 by the tension coil spring 22 and the locking arm 19 abuts against the stopper 26 and is stably stopped. In this state, the claw 40 is remote from the pin 41. Accordingly, if the force pushing down on the arm 7 is released, the arm 7 is raised by the torsion coil spring 49 (FIG. 5). When this rising movement starts, the pin 20 at the back of the locking arm 19 exerts pressure on the back part 27 (FIG. 7) of the locking arm 19 and the locking arm 19 is gradually moved in the return direction. During this period, the pin 41 rises and passes over the claw 40. After the pin 41 has passed over the claw 40, the pin 20 on the back of the locking arm 19 impinges against the inclined portion 25 as shown in FIG. 8, and the locking arm 19 is forced to move to the position indicated by the solid line. The pin 20 further moves and pushes against the inclined back portion 25 of the arm 19, so that the tension coil spring 22 is passed over the center of the supporting shaft 23 and moved above the center of the supporting shaft 23, and the pin 20 rises and passes over the upper part 28 of the inclined portion 25.

Figure 6:
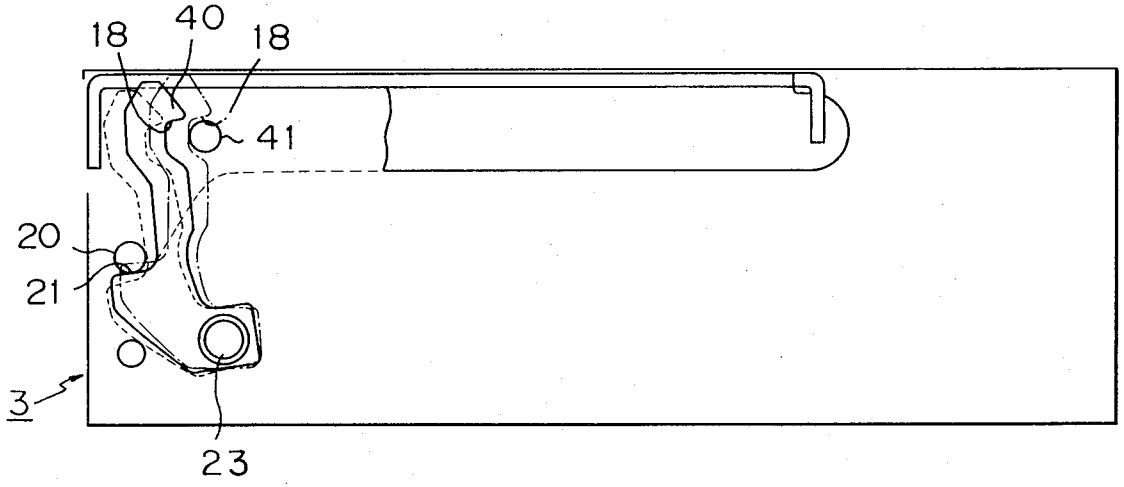
Figure 7:
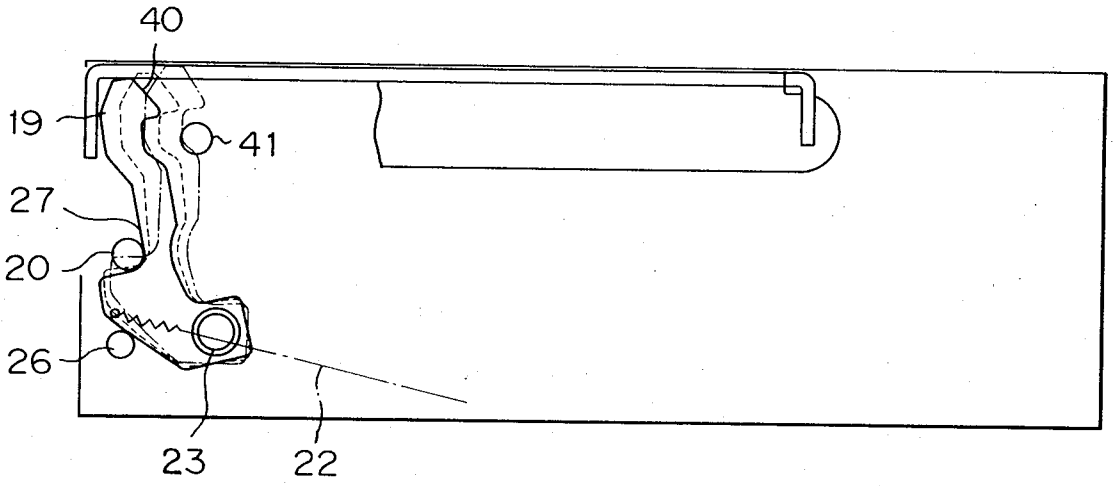

After the pin 41 of the arm 7 is thus withdrawn from the claw 40, the locking arm 19 is pushed in the return direction by the pin 20 and the locking coil spring 22 restores the locking arm 19 to the locking state. Note, as shown in FIG. 6, when the arm 7 in the locked state is further pushed down to unlock the arm 7, the printing head 8 is further pressed against the platen 5. However, no problem occurs because the printing head 8 is attached to the arm 7 by a plate spring 17 which absorbs this pressure.

Only one set of elements comprising the locking arm 19 and pins 40 and 20 is shown in the drawings. If this set is arranged on each of the left and right sides of the arm 7, locking becomes more stable. In this case, each of pins 41 and 20 may be formed by a rod extending between the left and right ends of the arm 7. Similarly, the supporting shaft 13 of the locking arm 19 may be formed by a long rod.

If the locking mechanism having the above-mentioned structure is adopted, by just a slight push down on the moving member such as the arm 7 in the same direction as in case of locking, the moving member is released from locking. Furthermore, when the moving member is returned to the original position, the inclined portion of the locking arm 19 is pressed against by the pin 20 and the locking arm 19 is restored to the locking position. Accordingly, the unlocking operation is much easier than in the conventional locking mechanism. When the locking arm 19 is withdrawn to the unlocking state, the pin 41 separates from the engaging face 18 of the locking claw 40 in the vertical direction. Accordingly, a change of the locking position due to sliding abrasion between the pin 41 and locking claw 40 does not occur and locking can be effected at a constant position with a high precision.

The intensity or strength of the spring for opening the lid will now be described. When the lid is manually opened, if the force of the torsion coil spring is in balance with the load of the lid, the lid can be stopped at an optional position.

Figure 9B:
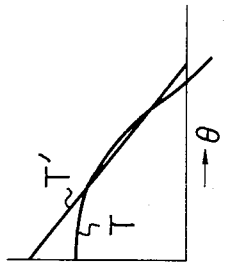
FIGS. 9 (*a*) and (*b*) are diagrams illustrating the action of a force on an opening-closed arm of the printing medium-attaching portion.
Figure 9A:
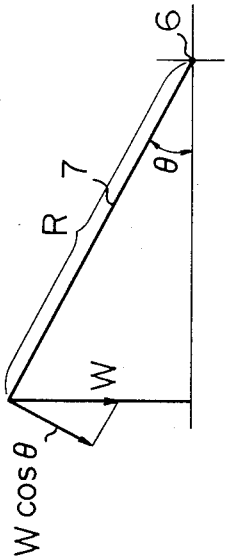
Figure 10:
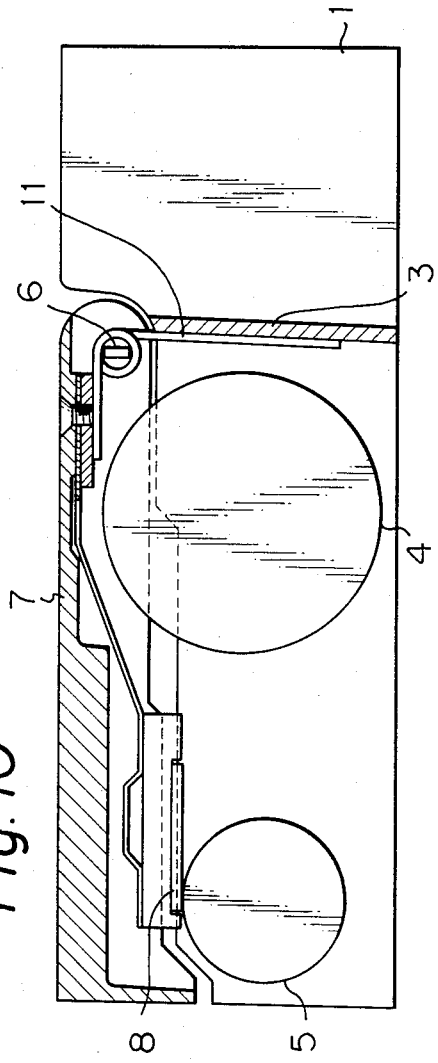
FIG. 10 is a diagram illustrating the structure of the opening-closing arm of the printing medium-attaching portion.

FIG. 9(*a*) is a diagram illustrating the relationship between the position of the arm 7 and the load, and FIG. 9(*b*) is a diagram illustrating the relation between the spring force of the torsion coil spring 11 and the load on the side of the arm 7. FIG. 10 is a side view showing the portion for attachment of the torsion coil spring 11. As shown in FIGS. 9(*a*) and (*b*), the weight T on the side of the arm 7 changes according to WR $\cos\theta$ relative to the angle $\theta$ around the supporting shaft 6, while the spring force T' of the torsion coil spring acts according to $T_0-k\theta$ relative to the abovementioned angle $\theta$. Accordingly, if the spring force $T_0$ at the position where $\theta=0°$ and the constant k are appropriately selected, the difference between (WR $\cos\theta$) and ($T_0-k\theta$) can be controlled to a very small constant value over a broad range of the angle $\theta$. Note, a certain amount of friction cannot be avoided even in a bearing mechanism used in the supporting shaft 6. However, if the above-mentioned constant value is kept smaller than the force of this friction, the arm 7 can be stopped at an optional position.

Figure 11:
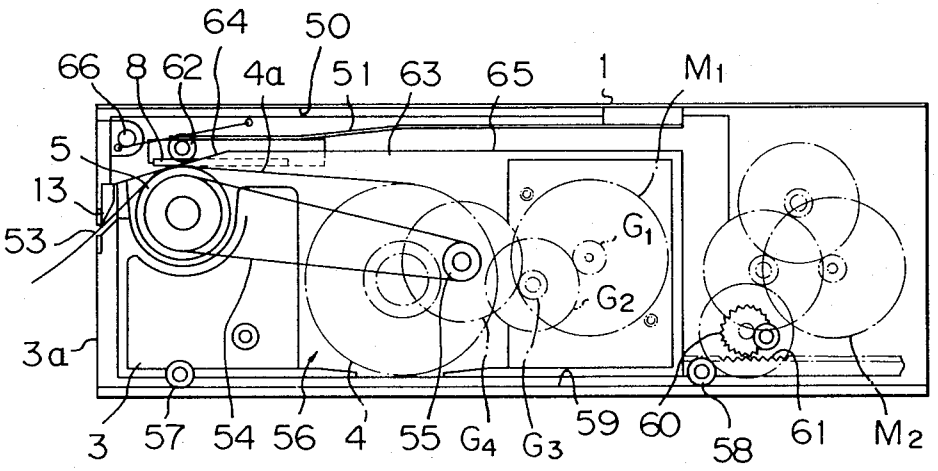
FIG. 11 is a side view illustrating another example of the printing medium-attaching portion of the invention in the normal state.

In each of the foregoing embodiments, there is adopted a structure in which the printing head is drawn out to the front face of the casing together with the draw-out frame. Another embodiment of the present invention, in which only the printing medium-attaching portion is drawn out from the interior of the casing while the printing head is left in the casing, will now be described with reference to FIGS. 11 and 12.

To enable the printing medium-attaching portion to be drawn out from the casing 1, a roll 4 having the printing medium wound thereon is attached to the draw-out frame 3. A printing zone comprises the platen 5 and the printing head 8.

In the present embodiment, the platen 5 is attached to the draw-out frame 3, and the printing head 8 is attached to a inner top portion 50 of the casing 1 through a plate spring 51. A printing paper 4*a* delivered from the roll 4 is passed through and between the platen 5 and the printing head 8 and delivered outward through an opening 53 between a cutter 13 and a front face plate 3*a*. In order to deliver the printing paper 4*a* from the roll 4 in this manner, the platen 5 is connected to a pulley 55 through a belt 54. This pulley 55 is connected to a motor M1 through reduction gears comprising a gear G1 secured to the shaft of the motor M1 and gears G2, G3, and G4. When the platen 5 is rotated by the motor M1, the printing paper 4*a* inserted between the platen 5 and the printing head 8 by the spring pressure of the plate spring 51 is fed at a constant speed, the heat-generating element of the printing head 8 is actuated according to input printing information to selectively generate heat, and the heat-sensitive recording appear 4*a* is heated to effect printing. The printing paper 4*a* on which printing is completed is then cut by the cutter 13.

The platen 5, the printing medium-attaching portion 56 to which the printing paper roll 4 is attached, the reduction gear mechanism comprising the above-mentioned gears G1 through G4, and the driving motor M1 are mounted on the draw-out frame 3. Rollers 57 and 58 are attached to the draw-out frame 3 so that the drawout frame 3 can be moved forward and backward on the bottom portion 59 of the casing 1. A motor M2 and a reduction gear mechanism comprising a plurality of gears are arranged on the back of the draw-out frame 3 in the casing 1, and a pinion 60 at the final stage of this reduction gear mechanism is engaged with a rack 61 secured to the draw-out frame 3. Accordingly, when the pinion 60 is rotated by the motor M2, the draw-out frame 3 is moved forward and backward together with the rack 61, and as shown in FIG. 12, the draw-out frame 3 can be drawn out from or contained in the casing 1.

Figure 12:
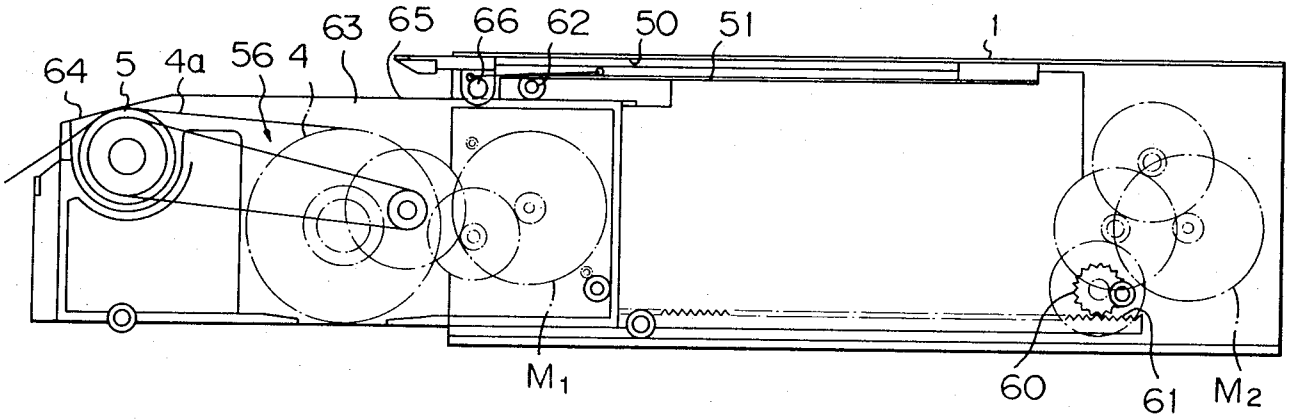
FIG. 12 is a side view illustrating the printing medium-attaching portion of FIG. 11 in the state where it is drawn out.

When the draw-out frame 3 is drawn out from the casing 1 as shown in FIG. 12, and after the platen 5 has moved forward of the printing head, the portion of the draw-out frame 3 that subsequently passes through the lower portion of the printing head 8 may impinge against the printing head 8 and inhibit the passage of the drawout frame 3. To avoid this, rollers 62 are attached on both ends of the printing head 8, and inclined parts 64 are formed on both the left and right side plates of the draw-out frame 3 on both sides of the platen 5. Accordingly, when the draw-out frame 3 is drawn out from the casing 1, the rollers 62 are pushed up by the inclined parts 64 and the printing head 8 rises so that it is separated from the platen 5 and moved toward the inner top portion 50 against the plate spring 51. Then, the portions subsequent to the platen 5 pass below the printing head 8. Accordingly, the printing medium-attaching portion 56 can be drawn out without hindrance by the printing head 8. When the draw-out frame 3 is returned to the casing 1, the top ends 65 of the side plates 63 pass under the portion of the printing head 8 and the inclined parts 64 pass through the position of the printing head 8, the printing head 8 is brought down and pressed against the platen 5.

The cutter 13 is attached to the draw-out frame 3 in such a manner that the cutter 13 can be moved forward and backward together with the draw-out frame 3. Alternatively, the cutter 13 may be attached to the casing 1. In the latter case, the cutter 13 is rotatably attached to a rotation shaft 66 attached to the casing 1, and it is necessary to adopt a structure in which the cutter 13 is rotated and raised to the position illustrated in FIG. 12, and locked in that position, when the draw-out frame 3 is drawn out.

The operation of attaching the printing medium will now be described. If the operation switch is actuated when the draw-out frame 3 is contained in the casing 1 as shown in FIG. 12, the motor M2 is started and the rack 61 is transferred forward by the pinion 60, whereby the draw-out frame 3 is moved forward and drawn out from the casing 1. At the initial stage of this forward movement, the rollers 62 are pushed up by the inclined parts 64 of the side plates of the draw-out frame 3 and the printing head 8 moved upward, as described previously, thus producing the state shown in FIG. 12. In the state where the printing medium-attaching portion 56 is thus exposed outside the casing 1, the printing paper roll 4 is attached to the printing medium-attaching portion 56, and the printing paper 4a is guided to the opening 53 below the cutter from the platen 5. Then, the operation switch on the front face plate 3*a* is actuated to rotate the motor M2 in the reverse direction, and the draw-out frame 3 is moved backward together with the rack 61 and drawn into the casing 1. By the passage of the above-mentioned inclined parts 64 through the vicinity of the printing head 8, the printing head 8 is brought down together with the rollers 62 and the printing paper 4a is pressed against the platen 5 to produce the stage shown in FIG. 11. In this state, the printing paper is fed by the motor M1 and printing is carried out.

As is apparent from the foregoing description, according to the present invention, the printing zone comprising the platen 5 and the thermal head 8 and the portion to which the printing medium roll 4 is attached are arranged in the integral draw-out frame 3 and this draw-out frame 3 is contained and supported in the casing through the moving mechanism. Accordingly, when the printing medium is to be attached or detached, the operation of exchanging the printing medium can be performed while the draw-out frame 3 is drawn out from the casing and exposed outside the casing. Therefore, an empty space is formed on the top face of the casing, and other devices can be placed on the casing or the printer can be contained in a rack, with the result that an effective utilization of space becomes possible. Furthermore, since a structure is adopted in which the draw-out frame 3, including the printing zone and the printing medium-attaching portion, are arranged is operated at the front face, the operation panel can be disposed on the front face. Therefore, the printer can be placed not only on a desk but also at a higher location such as a cabinet, with the result that the freedom of locating the printer is further increased.

Also, since the platen and the printing paper roll are horizontally arranged in parallel to each other within the draw-out frame, the thickness of the casing can be reduced, and a thin and compact printer can be provided.

Furthermore, when the present invention is applied to an image printer for printing image signals, since the image can be reversed in the vertical direction and the horizontal direction by the control circuit, the printing paper can be taken out from the front face and the printing head can be arranged above the printing paper. Accordingly, charging of the printing paper roll can be completed only by inserting the printing paper roll from above.

Since charging of the printing paper roll is carried out when the lid located above the printing medium-attaching portion is wide open, the printing paper roll can be set very easily.

Because the printer has a thin and cuboidal shape, and other devices can be therefore placed on the printer, where the printer is used in combination with a television set, a video tape deck, a personal computer or the like, such other devices can be placed on the printer or the printer and other device can be contained as one system in a rack and be operated at the front face. Accordingly, space can be effectively utilized, versatility is increased and the appearance is improved.

Moreover, if a structure is adopted in which only the printing medium-attaching portion is drawn out from the casing while the printing head is left in the container, the printing head is not exposed outside, and therefore, the adhesion of dust to the printing head or damage to the printing head by erroneous operation accident can be prevented.

We claim:

1. A printer, comprising:

a casing having a substantially cuboidal shape with an operation panel formed on a front face thereof;

a printing unit including a printing medium-attaching portion, and a printing head portion pivotably attached to the printing medium-attaching portion so that the printing head portion pivots between open and closed positions;

moving means for supporting said printing unit so that the printing unit can be drawn out from the front face of the casing, and for automatically positioning the printing head portion in the open position when the printing unit is drawn out from the casing; and a control circuit for controlling the printing operation of the printing head portion.

2. A printer as set forth in claim 1, wherein the front face of the casing has a rectangular shape in which the height is smaller than the width and the operation panel and the printing medium-attaching portion are arranged on the front face in parallel to each other with respect to the direction of the width.

3. A printer as set forth in claim 1, wherein a passage for discharging a printed printing medium to the outside is formed on the front face of the printing medium-attaching portion.

4. A printer as set forth in claim 1, wherein said moving means comprises a spring for positioning the printing head portion in the open position, said spring having a spring force capable of overcoming the load of the printing head portion.

5. A printer as set forth in claim 1, further comprising a rotary locking arm mounted on the printing medium-attaching portion for maintaining the closed state of the printing head portion.

6. A printer as set forth in claim 1, wherein at least a thermal head is arranged in the printing head portion and at least a roll of a heat-sensitive recording paper and a paper feed roller are arranged in the printing medium-attaching portion.

7. A printer as set forth in claim 1, wherein printing control in the printing head portion is the printing control of image information.

8. A printer as set forth in claim 1, which is used in combination with other devices placed on the top face of the printer.

9. A printer as set forth in claim 1, wherein a platen is drawn out forward together with the printing medium-attaching portion and said platen is horizontally arranged together with a roll of a printing medium.

* * * * *